United States Patent [19]

Osano

[11] Patent Number: 4,844,042

[45] Date of Patent: Jul. 4, 1989

[54] CONTROL SYSTEM FOR AN ACTUATOR OF AN AUTOMOTIVE ENGINE

[75] Inventor: Hisashi Osano, Koganei, Japan

[73] Assignee: Fuji Jukogyo Kabushiki Kaisha, Tokyo, Japan

[21] Appl. No.: 174,712

[22] Filed: Mar. 29, 1988

[30] Foreign Application Priority Data

Apr. 2, 1987 [JP] Japan ..... 62-81597

[51] Int. Cl.[4] ..... F02D 41/10

[52] U.S. Cl. ..... 123/492; 123/422; 123/488; 73/118.2

[58] Field of Search ..... 123/492, 488, 422; 73/118.2

[56] References Cited

U.S. PATENT DOCUMENTS 4,227,507 10/1980 Takase et al. ..... 123/492

4,256,073 3/1981 Kobashi et al. ..... 123/422

4,562,814 1/1986 Abo et al. ..... 123/492

FOREIGN PATENT DOCUMENTS 59-183038 10/1984 Japan .

*Primary Examiner*—Andrew M. Dolinar

*Attorney, Agent, or Firm*—Martin A. Faber

[57] ABSTRACT

A control system for a fuel injection system has a mass air flow meter for producing an air flow signal dependent on quantity of induced air, and an acceleration detector for detecting acceleration of the engine and for producing an acceleration signal. In response to the acceleration signal, the value of the air flow signal is reduced for a time. An actuator of the fuel injection system is operated in accordance with the reduced air flow signal.

11 Claims, 5 Drawing Sheets

CONTROL SYSTEM FOR AN ACTUATOR OF AN AUTOMOTIVE ENGINE

BACKGROUND OF THE INVENTION

The present invention relates to a control system for an automotive engine, and more particularly to a system for controlling an actuator for a system such as a fuel injection system.

In an ordinary engine control system, the amount of fuel injection and ignition timing of the engine are determined based on the intake air flow rate detected by a mass air flow meter and engine speed detected by a crank angle sensor. Japanese Patent Application Laid-Open No. 59-183038 discloses a system in which fuel injection is controlled to enrich the air-fuel mixture when the engine is accelerated. Referring to FIG. 6, when the throttle valve is quickly opened as shown by throttle position $\theta$, a mass air flow meter employed with a hot wire or hot film produces an output signal representing the quantity Qa of intake air. However, the quantity Q of actual intake air is induced in the cylinder with a delay because of the volume of the intake system. Hence, the amount of fuel injection calculated based on the detected intake air quantity becomes large compared with the quantity of actually induced air, so that air fuel mixture becomes rich. Further, the ignition timing is set to a timing deflected to the advance side. As a result, engine power suddenly varies, causing stumble of the vehicle and making emission control worse.

SUMMARY OF THE INVENTION

The object of the present invention is to provide a control system which may improve driveability at the acceleration of the vehicle with a smooth acceleration of the engine.

The other objects and features of this invention will become understood from the following description with reference to the accompanying drawings.

DETAILED DESCRIPTION OF THE PREFERRED EMBODIMENT

Figure 1:
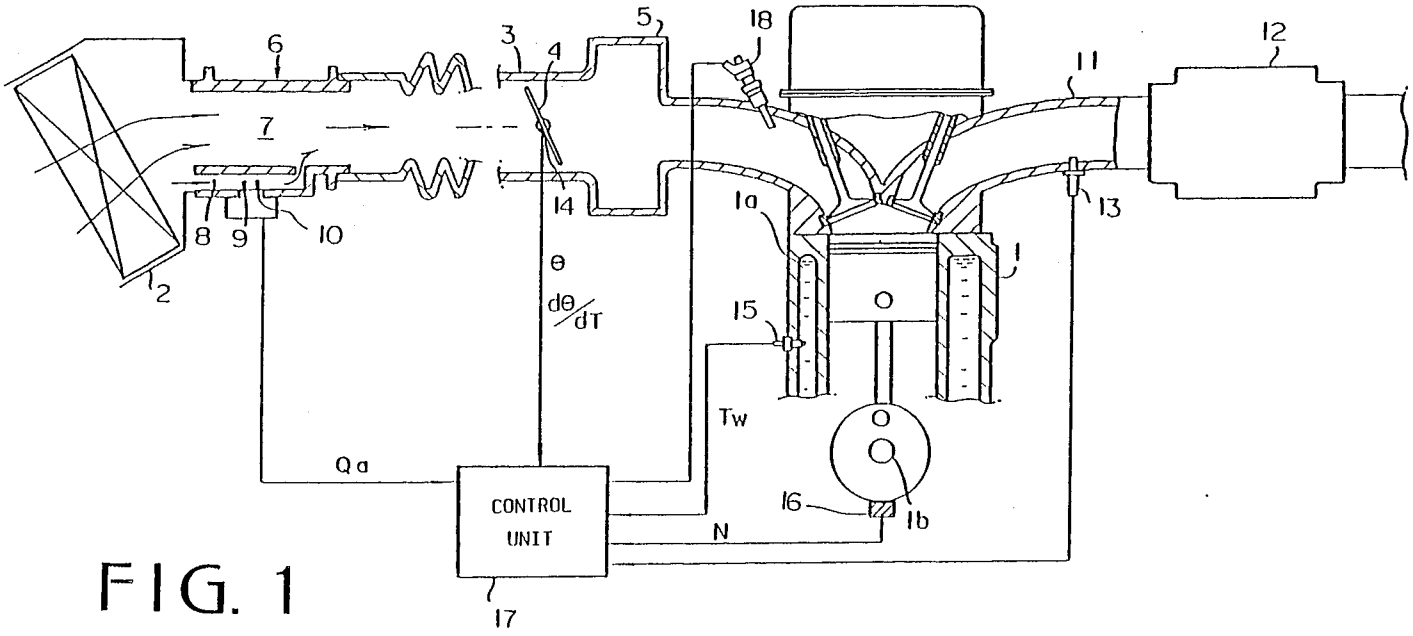
FIG. 1 is a schematic illustration showing a fuel injection system for an automotive engine according to the present invention.

Referring to FIG. 1, an internal combustion engine 1 for a vehicle is supplied with air, passing through an air cleaner 2, an intake pipe 3, a throttle valve 4, and a throttle chamber 5. A mass air flow meter 6 is provided on the intake pipe 3 downstream of the air cleaner 2 for detecting the quantity Qa of intake air in the intake pipe 3 and for producing an air flow signal dependent thereon. The air flow meter 6 has a bypass 8 provided around a main passage 7 of the intake pipe 3, and a hot wire 9 and a cold wire 10 provided in the bypass 8. An output signal of the air flow meter 6 is supplied to an electronic control unit 17 comprising a microcomputer. An $O_2$ sensor 13 and a catalytic converter 12 are provided in an exhaust passage 11. A throttle position sensor 14 is provided adjacent the throttle valve 4 for detecting opening degree of the throttle valve 4. A coolant temperature sensor 15 is provided on a water jacket 1a of the engine 1. A crank angle sensor 16 is mounted adjacent a crankshaft 1*b* of the engine 1 for detecting engine speed N. Output signals from these sensors are supplied to the control unit 17. The control unit 17 determines quantity of fuel to be injected from injector 18 actuated by an actuator 18*a*.

Figure 2:
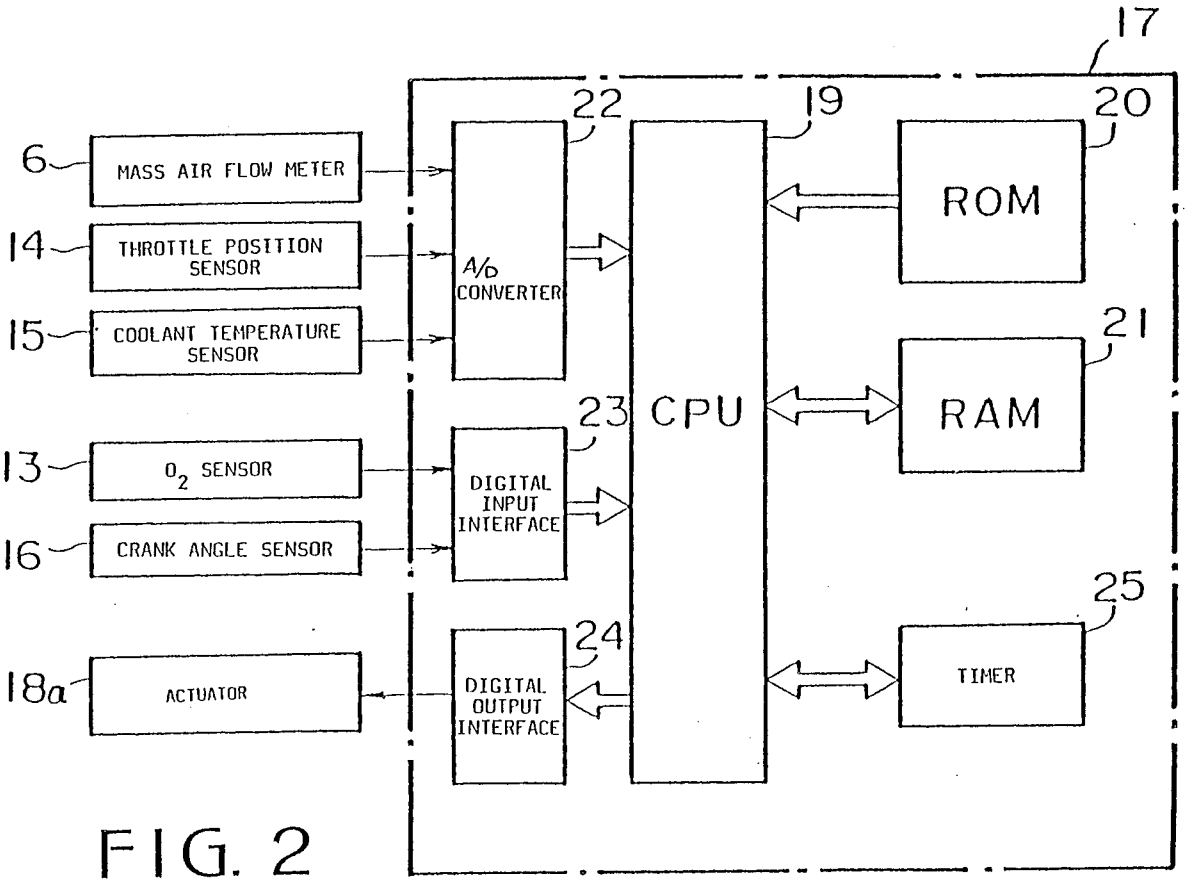
FIG. 2 is a block diagram of a control unit used in a system of the present invention.

Referring to FIG. 2, the electronic control unit 17 comprises a central processor unit (CPU) 19, a read only memory (ROM) 20, and a random access memory (RAM) 21. The control unit 17 operates in accordance with a program stored in the ROM 20. The CPU 19, ROM 20, and RAM 21 are connected to each other through bus lines. An A/D converter 22 connected to the CPU 19 is supplied with signals from the air flow meter 6, throttle position sensor 14, and coolant temperature sensor 15 to convert analog voltage signals into digital voltage signals. A digital input interface 23 is supplied with signals from $O_2$ sensor 13 and crank angle sensor 16. An output signal of the input interface 23 is supplied to the CPU 19. A digital output interface 24 produces a pulse signal for driving the actuator 18*a* in responsive to an output signal of the CPU 19. A timer 25 is provided in order to set a time during which the output signal of the air flow meter 6 is corrected.

Figure 3:
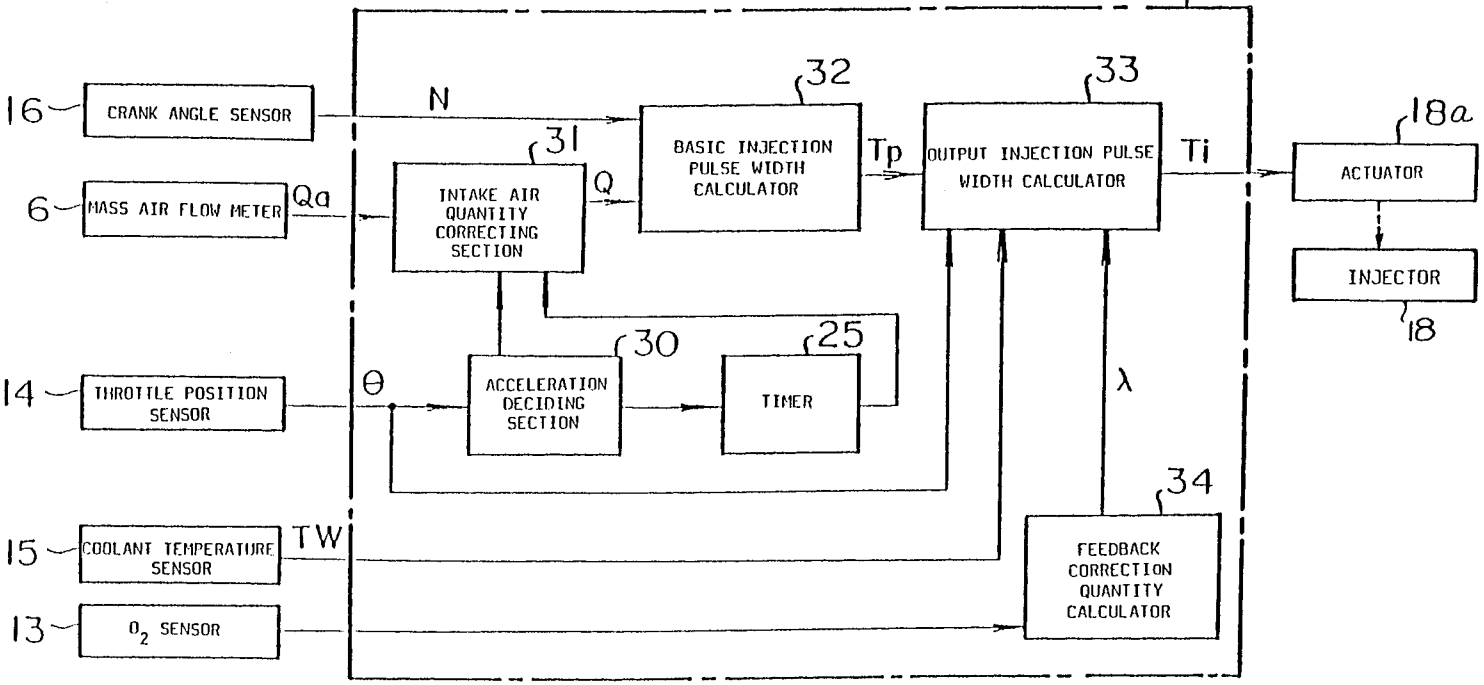
FIG. 3 is a block diagram of the control unit.

Referring to FIG. 3, the control unit 17 has an acceleration deciding section 30 to which the throttle position signal $\theta$ from the throttle position sensor 14 is applied. The acceleration deciding section 30 produces an acceleration signal when the throttle opening changing rate $d\theta/dt$ exceeds a predetermined value. The control unit 17 further has an intake air quantity correcting section 31 applied with the air flow signal Qa from the air flow meter 6. The acceleration signal is supplied to the intake air quantity correcting section 31 and to the timer 25 for correcting the quantity of the intake air in accordance with the acceleration signal from the acceleration deciding section 30 and with the signal from the timer 25. In a steady state of the engine, the air flow signal Qa representing intake air quantity at the air flow meter 6 is supplied to a basic injection pulse width calculator 32 without correction. The basic injection pulse width calculator 32 is further supplied with the engine speed signal N from the crank angle sensor 16 for calculating a basic injection pulse width Tp by the following equation;

$$Tp = k \cdot Q/N \text{ (k is a constant)}$$

The output signal Tp is applied to an output injection pulse width calculator 33, where an output injection pulse width Ti is calculated by correcting the basic injection pulse width Tp in accordance with engine operating conditions. In order to correct the basic injection pulse width Tp, output signal p74 from the throttle position sensor 14 and output signal TW from the coolant temperature sensor 15 are applied to the calculator 33. A feedback correction quantity calculator 34 is provided for calculating a correcting value in accordance with a feedback signal from the $O_2$ sensor 13. The correcting quantity signal $\mu$ is applied to the calculator 33 to correct the basic injection pulse width Tp. The output injection pulse Ti is applied to an actuator 18*a* of the injector 18 for injecting fuel into cylinders of the engine 1.

When the throttle opening changing rate $d\theta/dt$ exceeds the predetermined value, the acceleration deciding section 30 produces the acceleration signal which is supplied to the timer 25. The timer 25 starts to count a set time t and produces a timer signal which is applied to the correcting section 31. Responsive to the acceleration signal from the deciding section 30, the intake air quantity correcting section 31 operates to correct the detected intake air quantity Qa by multiplying a correcting coefficient K ($0<K<1$) during the set time t. That is, the intake air quantity Q is obtained by a calculation $Q = K \times Qa$. The corrected quantity signal Q is applied to the calculator 32. When the set time t lapses, the detected quantity signal Qa is produced as the quantity signal Q.

Figure 4:
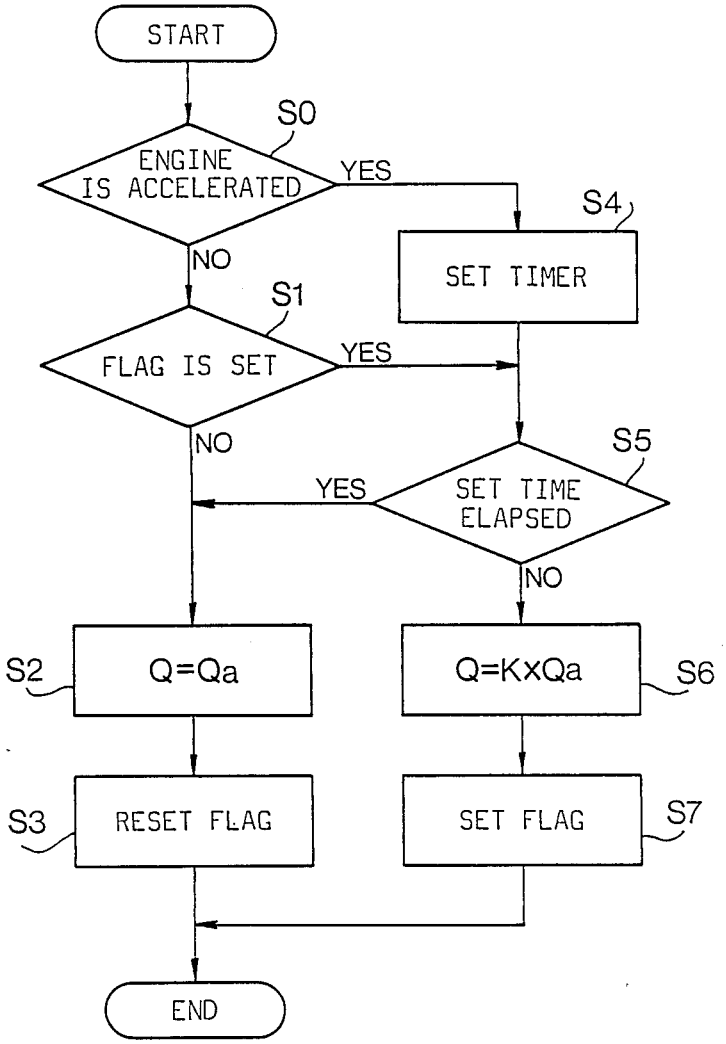
FIG. 4 is a flow chart showing the operation of the system.

Describing the correcting operation of the control unit with reference to the flow chart of FIG. 4, it is determined whether the engine is accelerated or not in accordance with the throttle position changing rate $d\theta/dt$ at a step S0. When the engine is not accelerated, the program proceeds to a step S1 where it is determined whether a flag is set or reset. When the flag is reset at the step S1, the program proceeds to step S2 at which the detected quantity signal Qa is provided as the quantity signal Q. The program proceeds to a step S3 where the flag is reset. When the flag is set at the step S1, the program goes to a step S4.

On the other hand, when the acceleration of the engine is determined at the step S0, the program proceeds to the step S4 where the timer 25 is set to start counting the set time t. At a step S5, it is determined whether the set time t elapses or not. When the set time does not elapse, the program goes to a step S6. At the step S6, the calculation $Q=K \times Qa$ is made. At a step S7, the flag is set and the program terminates. When the counting number T of the timer 25 reaches the number of set time t at the step S5, the program proceeds to the step S2.

Figure 5:
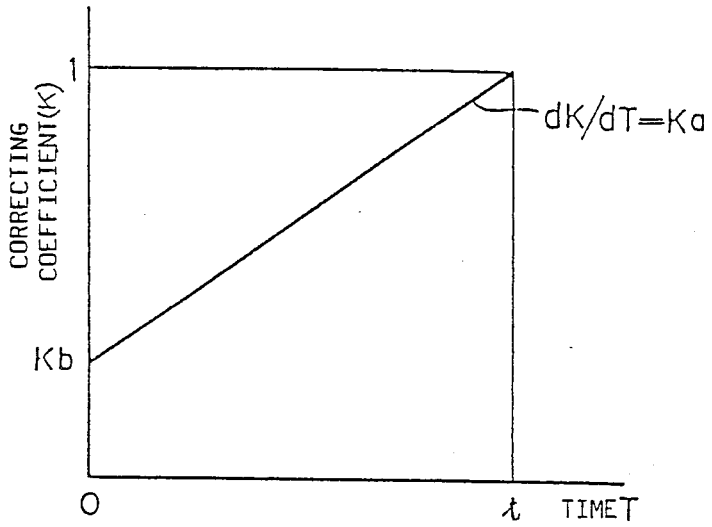
FIG. 5 is a graph showing a characteristic of a correcting coefficient with time.
Figure 6:
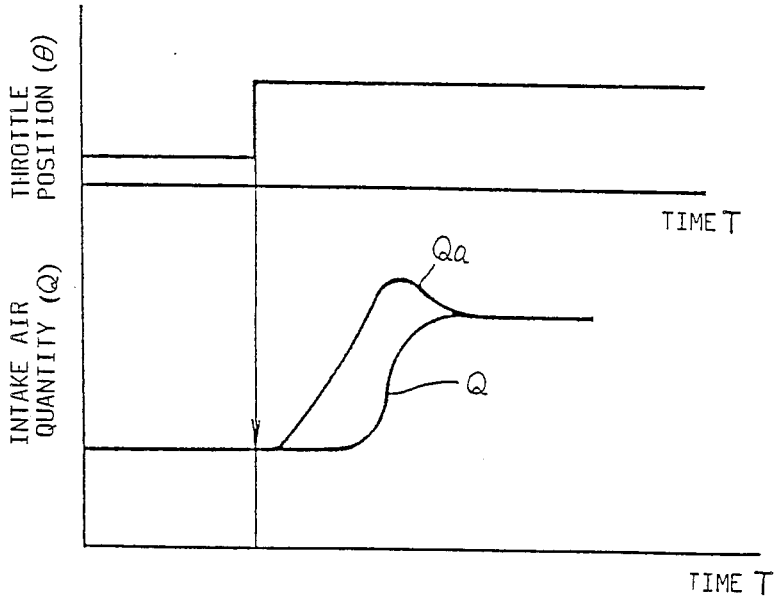
FIG. 6 is a graph showing variations of intake air quantity and output signal of an air flow meter.

The correcting coefficient K is provided to increase up to "1" with the time as shown in FIG. 5. Namely, the coefficient K is obtained by an equation $K=Ka \times T+Kb$, where Kb is an initial correcting coefficient ($0<Kb<1$) after the acceleration of the engine and Ka is an increment of the correcting coefficient K represented by dK/dT. The increment Ka is set in such a value that when the counting number T of the timer 25 reaches the set time t, K becomes equal to one ($K=1$), that is $Q=Qa$. The correcting coefficient K is increased so as to converge the corrected intake air quantity Q to the detected intake air quantity Qa at the time t. During the predetermined time after the engine is accelerated, the intake air quantity signal Qa is decremented, so that the signal is adjusted to represent the intake air quantity actually entered into the engine, thereby providing an optimum air fuel ratio. In this case, the increment Ka may be set to zero as a constant value of $K=Kb$.

Although the present invention is described with respect to an embodiment applied to a fuel injection system, the invention may be used in an ignition timing control system. In the ignition timing control system, calculators 32 and 33 are provided for calculating ignition timing.

In accordance with the present invention, the quantity of intake air is corrected during a predetermined period after the engine is accelerated to appropriately provide the fuel injection amount. Similarly, ignition timing is controlled in accordance with the corrected intake air quantity.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A control system for an actuator of an automotive engine having an intake system comprising:

a mass air flow meter disposed in the intake system for producing an air flow signal dependent on quantity of induced air;

an acceleration detecting means for detecting acceleration of the engine and for producing an acceleration signal when the acceleration exceeds a predetermined value;

a timer responsive to the acceleration signal for producing a timer signal for a predetermined time which corresponds to time between detection of the air with the mass air flow meter and induction of the air into a cylinder of the engine;

corrector means responsive to the air flow signal, the acceleration signal and to the timer signal for reducing the air flow signal in value producing a corrected quantity signal; and output means responsive to the corrected quantity signal for producing an output signal for operating the actuator.

2. The system according to claim 1 wherein the corrected quantity signal is gradually increased during the predetermined time.

3. The system according to claim 1, wherein the actuator is an actuator of a fuel injector.

4. A control system according to claim 1, wherein said corrector means decrements the air flow signal in value to produce the corrected quantity signal such that the corrected quantity signal represents intake air quantity actually entering the engine.

5. A control system according to claim 4, wherein the corrected quantity signal is increased incrementally during the predetermined time.

6. A control system according to claim 5, wherein said corrector means increases the corrected quantity signal incrementally during the predetermined time by a constant increment of a correcting coefficient.

7. A control system according to claim 6, wherein said corrector means increases the corrected quantity signal incrementally during the predetermined time by increasing the correcting coefficient with time during the predetermined time.

8. A control system according to claim 7, wherein said correcting coefficient linearly increases during the predetermined time.

9. A control system according to claim 7, wherein said corrector means produces the corrected quantity signal by multiplying the correcting coefficient and the air flow signal.

10. A control system according to claim 1, wherein at the end of the predetermined time the corrector means converges the corrected quantity signal to the air flow signal in value.

11. A control system according to claim 10, wherein said corrector means produces the corrected quantity signal by multiplying a constant correcting coefficient and the air flow signal.

* * * * *